US005921802A

United States Patent [19]

Reiswig et al.

[11] Patent Number: 5,921,802

[45] Date of Patent: Jul. 13, 1999

[54] GUIDE FOR FEMALE BNC CONNECTOR PART

[75] Inventors: Daniel D. Reiswig; Scott A. Matheson; Charles S. Meyer, all of Nevada City, Calif.

[73] Assignee: Nvision, Inc., Grass Valley, Calif.

[21] Appl. No.: 09/021,475

[22] Filed: Feb. 10, 1998

[51] Int. Cl.[6] ..... H01R 13/64

[52] U.S. Cl. ..... 439/374; 439/380

[58] Field of Search ..... 439/374, 378, 439/380, 355, 357

[56] References Cited

U.S. PATENT DOCUMENTS 4,595,251 6/1986 Moulin ..... 439/355

5,131,862 7/1992 Gershfeld ..... 439/357

5,718,597 2/1998 Kodama ..... 439/374

*Primary Examiner*—Paula Bradley

*Assistant Examiner*—Katrina Davis

*Attorney, Agent, or Firm*—Smith-Hill and Bedell

[57] ABSTRACT

A snap-on guide for assisting engagement of a push-on BNC plug with a BNC receptacle has a sleeve adapted to fit over the barrel of the receptacle. The sleeve is formed at one end with two diametrically opposed slots for receiving respective bayonet pins of the receptacle, the slots being configured for engaging the bayonet pins in a manner that tends to retain the sleeve on the barrel against a force tending to remove the sleeve from the barrel. The guide has an extension with an interior surface which flares outward from the sleeve at its opposite end from the slots for receiving and guiding engagement of the plug.

10 Claims, 1 Drawing Sheet

GUIDE FOR FEMALE BNC CONNECTOR PART

BACKGROUND OF THE INVENTION

This invention relates to a guide for female BNC connector part.

The conventional BNC connector is composed of a female part or receptacle and a male part or plug. The female part includes a cylindrical barrel with two diametrically opposed pins projecting radially therefrom. The male BNC connector part may be of either the lock-on type or the push-on type. The lock-on type of male BNC connector part includes a pin which is fitted in the barrel of the female connector part and a shell which is fitted over the barrel and is formed with two diametrically opposed J-shaped slots which receive the pins of the female connector part. To engage the lock-on type of male BNC connector part, the two parts are brought together by linear, non-rotational movement so that the pins slide in the J-shaped slots respectively until the pins bottom in the slots. The two parts then undergo relative rotational movement through a small angle and the pins become captive in the slots. The push-on type of male BNC connector part does not include the shell and is fully engaged with the female part by linear, non-rotational relative movement.

BNC connectors having a male part of the push-on type are widely used in bulkhead applications, in which one part of the connector is mounted in a rear frame bulkhead of a piece of electronic equipment and the other part of the connector is mounted in a rear wall of a plug-in module to be fitted in the frame. The connector is automatically engaged when the plug-in module is installed in the frame. This type of application is inconvenient because the person installing the plug-in module in the frame cannot usually see the connector parts and therefore it can be difficult to position the plug-in module properly for engagement of the connector. A solution to this problem is to use a connector in which the female connector part has a flared barrel which guides engagement of the male connector part when the plug-in module is installed in the frame. However, the female connector part having a flared barrel is much more expensive than the female connector part having a cylindrical barrel.

BNC connectors having a male part of the push-on type can also be used in an edge-mount application, in which one part of the connector is installed in the rear wall of a mounting frame and the other part is attached to an edge of a printed circuit board. The printed circuit board is fitted in guides built into the mounting frame and is inserted into the frame. As the board approaches the fully inserted position, the two parts of the BNC connector engage. In this application, the connector parts may not be completely hidden from view when the board is being inserted into the frame, but it can nevertheless be awkward to align the circuit board properly in the guides so that the connector will engage.

SUMMARY OF THE INVENTION

In accordance with a first aspect of the invention there is provided a guide for assisting linear, non-rotational engagement of a push-on male connector part with a female connector part having a barrel with two diametrically opposed bayonet pins projecting radially therefrom, said guide comprising a sleeve portion adapted to fit over the barrel of the female connector part, said sleeve portion having first and second opposite ends and being formed at said first end with two diametrically opposed slots for receiving respective bayonet pins of the female connector part, at least one of said slots being configured for engaging the bayonet pin in a manner that tends to retain the sleeve portion on the barrel against a force tending to remove the sleeve portion from the barrel, and an extension having an interior surface which flares outward from the sleeve portion at said second end of the sleeve portion for receiving and guiding engagement of the male connector part.

In accordance with a second aspect of the invention there is provided electronic equipment comprising a bulkhead having a first part of a connector attached thereto and a removable module having a second part of the connector attached to a rear wall thereof, whereby on displacing the module toward the bulkhead, the two parts of the connector are engaged, one part of the connector being a push-on male connector part and the other part being a female connector part having a barrel with two diametrically opposed bayonet pins projecting radially therefrom, and the equipment further comprising a guide for assisting engagement of the two parts of the connector, said guide comprising a sleeve portion adapted to fit over the barrel of the female connector part, said sleeve portion having first and second opposite ends and being formed at said first end with two diametrically opposed slots for receiving respective bayonet pins of the female connector part, at least one of said slots being configured for engaging the bayonet pin in a manner that tends to retain the sleeve portion on the barrel against a force tending to remove the sleeve portion from the barrel, and an extension having an interior surface which flares outward from the sleeve portion at said second end thereof for receiving and guiding engagement of the male connector part.

In accordance with a third aspect of the invention there is provided electronic equipment comprising a bulkhead having a connector receptacle attached thereto, said connector receptacle having a barrel with two diametrically opposed bayonet pins projecting radially therefrom and being adapted to be engaged by a mating connector plug having a pin for insertion in the barrel of the receptacle, and the equipment further comprising a guide for assisting engagement of the plug with the receptacle, said guide comprising a sleeve portion adapted to fit over the barrel of the connector receptacle, said sleeve portion having first and second opposite ends and being formed at said first end with two diametrically opposed slots for receiving respective bayonet pins of the receptacle, at least one of said slots being configured for engaging the bayonet pin in a manner that tends to retain the sleeve portion on the barrel against a force tending to remove the sleeve portion from the barrel, and an extension having an interior surface which flares outward from the sleeve portion at said second end thereof for receiving and guiding engagement of the plug.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

Figure 1:
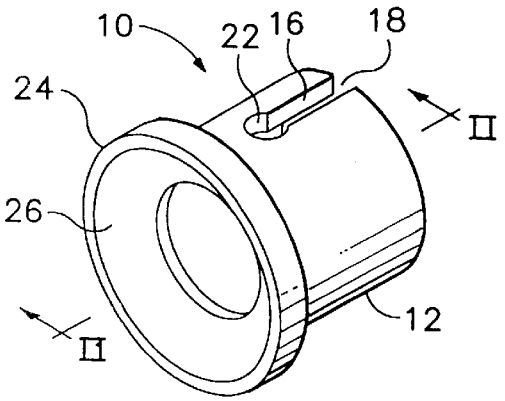
FIG. 1 is a perspective view of a BNC guide in accordance with the present invention.
Figure 2:
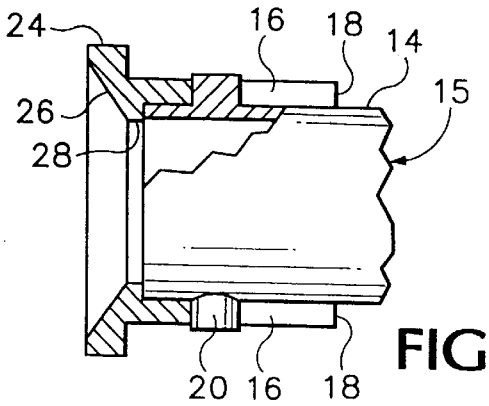
FIG. 2 is a sectional view of the BNC guide taken on the line II—II of FIG. 1, installed on a BNC receptacle.

The BNC guide 10 shown in FIGS. 1 and 2 is made of injection molded synthetic polymer material and has a cylindrical sleeve 12 of internal diameter sufficient to fit with a narrow clearance over the barrel 14 of a conventional BNC receptacle. Two diametrically opposed slots 16 extend lengthwise of the sleeve from an entrance 18 at one end of the sleeve 12. The slots are uniform in width, the width of the slots being slightly less than the diameter of a bayonet pin 20 of the BNC receptacle. At its inner end, the slot enlarges to form a circular opening 22 of slightly greater diameter than the pin. The material of the guide 10 allows the bayonet pin 20 to be pushed into the slot 16 by way of the entrance 18, forcing the slot open, and slide along the slot to its inner end. At the inner end, the pin enters the circular opening 22 and the slot snaps back to its former condition, behind the pin. The sleeve thus provides a detent which holds the guide 10 on the BNC receptacle 14 but allows the guide to be removed easily and non-destructively.

At its end opposite the entrances 18 of the slots, the sleeve 12 is provided with an extension 24 having a frusto-conical interior surface 26 which flares outward in the manner of a funnel.

It will be seen that the minimum internal diameter of the interior surface of the extension is less than the internal diameter of the sleeve, so that a lip 28 extends radially inward from the interior surface of the sleeve, over the end surface of the barrel 14.

For engaging the BNC receptacle equipped with the guide 10 with a BNC plug of the push-on type, the plug and receptacle are placed in approximate coaxial alignment, and when the two components are brought closer together, the extension 24 of the guide 10 receives the pin of the plug and guides it into the barrel of the receptacle. In this fashion, the function of the expensive receptacle with the flared barrel is achieved at much lower cost.

The lip 28 ensures that the end surface of the pin is guided radially inward beyond the end face of the barrel so that abutment of the pin with the end face of the barrel, which could interfere with engagement of the connector, is avoided.

Figure 3:
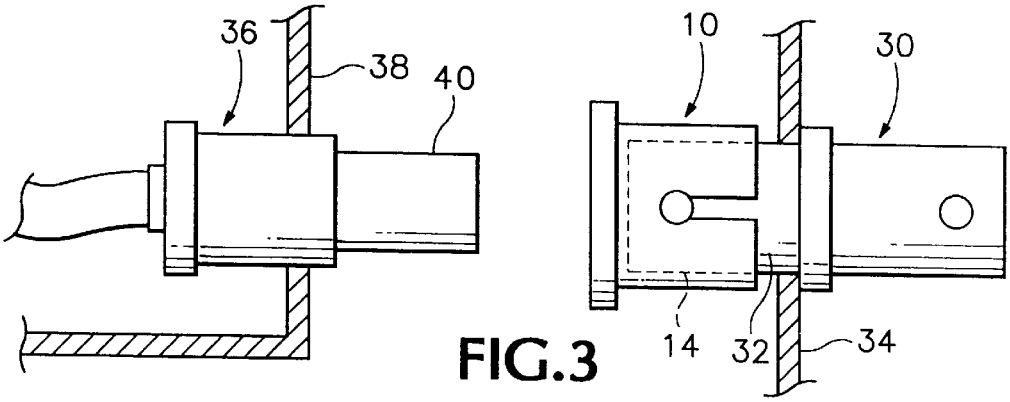
FIG. 3 shows use of the guide in a first bulkhead application.

FIG. 3 shows use of the guide in a bulkhead application in which a female/female BNC connector fitting 30 including a receptacle 32 is mounted in a rear frame bulkhead 34 and a push-on BNC plug 36 is mounted in the rear wall 38 of a removable plug-in module. The barrel 14 of the receptacle 32 is provided with a guide 10 as shown in FIGS. 1 and 2. When the module is pushed into position in the frame, the guide extension 24 guides the pin 40 of the plug 36 into engagement with the barrel 14 of the receptacle 32.

Figure 4:
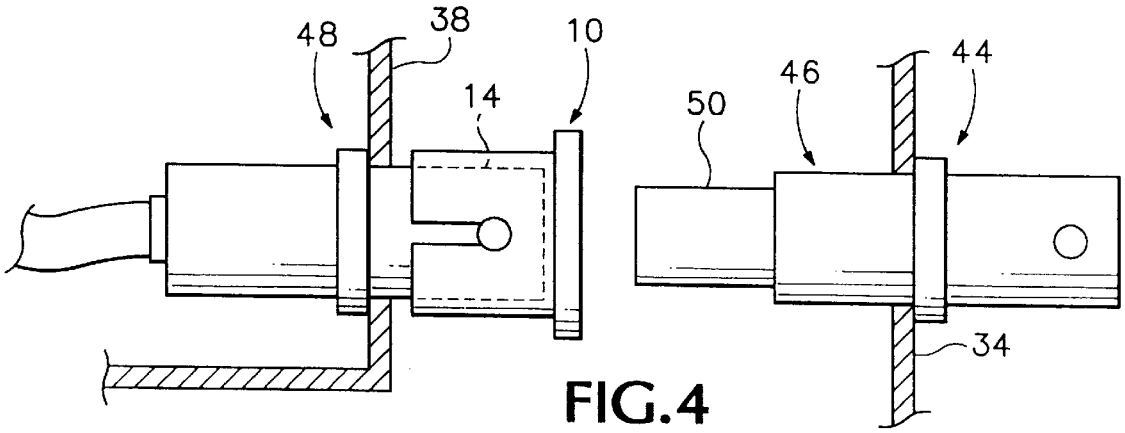
FIG. 4 shows use of the guide in a second bulkhead application.

FIG. 4 shows another bulkhead application in which a male/female connector fitting 44 including a plug 46 is mounted in the rear frame bulkhead 34 and the plug-in module is provided with a receptacle 48. A snap-on guide 10 as shown in FIGS. 1 and 2 is mounted on the barrel 14 of the receptacle 48 so that when the plug-in module is pushed into position in the frame, the pin 50 of the plug 46 constrains the barrel of the receptacle into proper alignment for engagement.

Figure 5:
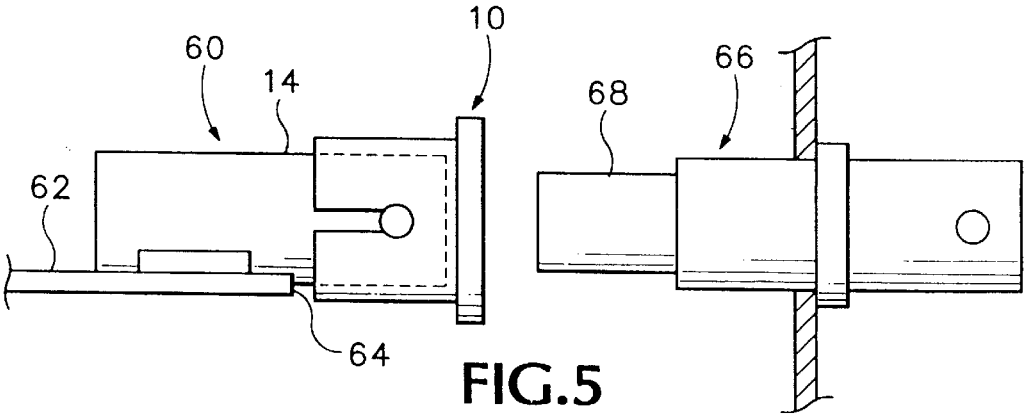
FIG. 5 shows use of the guide in an edge-mount application.

FIG. 5 shows an arrangement in which a receptacle 60 is attached to a circuit board 62. The central axis of the barrel 14 is parallel to but spaced from the plane of the circuit board and is perpendicular to an edge 64 of the circuit board. The barrel 14 has a proximal end at which it is attached to the circuit board 62 and a distal end projecting beyond the edge 64 of the circuit board. The receptacle 60 is provided with a snap-on guide as shown in FIGS. 1 and 2. When the circuit board is installed in a frame, and is pushed home for engagement with a plug 66 mounted at the rear of the frame, the extension of the guide engages the pin 68 of the plug and the plug then constrains the movement of the circuit board so that the plug engages the receptacle.

A patch panel may have a service side at which multiple BNC receptacles similar to the receptacle 48 shown in FIG. 4 are exposed. Multiple cables are each provided at a free end with a BNC plug adapted to engage any one of the receptacles. In use of the patch panel, an interconnection is made by manually engaging the plug at the free end of a selected cable with a selected receptacle. In the event that the plugs are of the push-on type, the individual receptacles may each be provided with a snap-on guide 10 to facilitate engagement of the plugs with the receptacles The snap-on guide can be fitted to a BNC receptacle in existing equipment, as well as being installed in new equipment.

It will be appreciated that the invention is not restricted to the particular embodiment that has been described, and that variations may be made therein without departing from the scope of the invention as defined in the appended claims and equivalents thereof. For example, the invention is not restricted to use of a slot configured as described above and other configurations may be used instead, including a keyhole-shaped slot, in which the entrance of the slot is wider than the pin and the edges of the slot converge to form a detent immediately before opening into the circular hole, and a J-shaped bayonet slot.

We claim:

1. A guide for assisting linear, non-rotational engagement of a push-on male connector part with a female connector part having a barrel with two diametrically opposed bayonet pins projecting radially therefrom, said guide comprising:

a sleeve portion adapted to fit over the barrel of the female connector part, said sleeve portion having first and second opposite ends and being formed at said first end with two diametrically opposed slots for receiving respective bayonet pins of the female connector part, at least one of said slots being configured for engaging the bayonet pin in a manner that tends to retain the sleeve portion on the barrel against a force tending to remove the sleeve portion from the barrel, and an extension having an interior surface which flares outward from the sleeve portion at said second end of the sleeve portion for receiving and guiding engagement of the male connector part.

2. A guide according to claim 1, wherein said one slot is narrower at an entrance of the slot than at an inner end of the slot, whereby on fitting the guide to the barrel of the female connector part, the guide can be retained on the barrel by snapping said one slot onto a pin of the female connector part.

3. A guide according to claim 1, wherein the interior surface of the extension is substantially frusto-conical.

4. A guide according to claim 3, wherein the interior surface of the frusto-conical extension has a minimum diameter less than the internal diameter of the sleeve portion.

5. Electronic equipment comprising a bulkhead having a first part of a connector attached thereto and a removable module having a second part of the connector attached to a rear wall thereof, whereby on displacing the module toward the bulkhead, the two parts of the connector are engaged, one part of the connector being a push-on male connector part and the other part being a female connector part having a barrel with two diametrically opposed bayonet pins projecting radially therefrom, and the equipment further comprising a guide for assisting engagement of the two parts of the connector, said guide comprising:

a sleeve portion adapted to fit over the barrel of the female connector part, said sleeve portion having first and second opposite ends and being formed at said first end with two diametrically opposed slots for receiving respective bayonet pins of the female connector part, at least one of said slots being configured for engaging the bayonet pin in a manner that tends to retain the sleeve portion on the barrel against a force tending to remove the sleeve portion from the barrel, and an extension having an interior surface which flares outward from the sleeve portion at said second end thereof for receiving and guiding engagement of the male part.

6. Electronic equipment according to claim 5, wherein the male part of the connector is attached to the bulkhead and the female part of the connector is attached to the removable module.

7. Electronic equipment according to claim 5, wherein the female part of the connector is attached to the bulkhead and the male part of the connector is attached to the removable module.

8. Electronic equipment according to claim 5, wherein the removable module is a circuit board and the barrel has a proximal end at which it is attached to the circuit board so that the central axis of the barrel is parallel to the circuit board and the barrel also has a distal end projecting beyond an edge of the circuit board.

9. Electronic equipment according to claim 5, wherein the removable module is a circuit board and the barrel has a proximal end at which it is attached to the circuit board so that the central axis of the barrel is parallel to the circuit board and spaced therefrom, and the barrel also has a distal end projecting beyond an edge of the circuit board.

10. Electronic equipment comprising a bulkhead having a connector receptacle attached thereto, said connector receptacle having a barrel with two diametrically opposed bayonet pins projecting radially therefrom and being adapted to be engaged by a mating connector plug having a pin for insertion in the barrel of the receptacle, and the equipment further comprising a guide for assisting engagement of the plug with the receptacle, said guide comprising:

a sleeve portion adapted to fit over the barrel of the connector receptacle, said sleeve portion having first and second opposite ends and being formed at said first end with two diametrically opposed slots for receiving respective bayonet pins of the receptacle, at least one of said slots being configured for engaging the bayonet pin in a manner that tends to retain the sleeve portion on the barrel against a force tending to remove the sleeve portion from the barrel, and an extension having an interior surface which flares outward from the sleeve portion at said second end thereof for receiving and guiding engagement of the plug.

* * * * *